US006371213B1

(12) United States Patent
Smith et al.

(10) Patent No.: US 6,371,213 B1
(45) Date of Patent: Apr. 16, 2002

(54) LIQUID OR FOAM FIRE RETARDANT DELIVERY DEVICE WITH PYROTECHNIC ACTUATION AND AERATION

(75) Inventors: Bradley W. Smith, Ogden, UT (US); William B. Richardson, Glendale, AZ (US); David W. Parkinson, Ogden; E. Lee Helms, Smithfield, both of UT (US)

(73) Assignee: Autoliv ASP, Inc., Ogden, UT (US)

( * ) Notice: Subject to any disclaimer, the term of this patent is extended or adjusted under 35 U.S.C. 154(b) by 0 days.

(21) Appl. No.: 09/504,979

(22) Filed: Feb. 15, 2000

(51) Int. Cl.[7] ..... A62C 11/00

(52) U.S. Cl. ..... 169/73; 169/33; 169/84; 239/322; 239/331; 239/369; 239/373; 239/419

(58) Field of Search ..... 169/11, 12, 9, 169/33, 46, 56, 58, 60, 71, 72, 73, 84, 85; 239/320, 321, 322, 329, 331, 340, 364, 365, 366, 368, 369, 373, 398, 418, 419, 429, 433, 590, 590.3

(56) References Cited

U.S. PATENT DOCUMENTS

| | | | | | |
|---|---|---|---|---|---|
| 749,374 | A | * | 1/1904 | Gates | 169/73 X |
| 2,381,607 | A | * | 8/1945 | Lee | 169/84 |
| 2,426,024 | A | * | 8/1947 | Jones et al. | 169/84 |
| 4,319,640 | A | | 3/1982 | Brobeil | |
| 5,351,760 | A | | 10/1994 | Tabor, Jr. | |
| 5,423,384 | A | | 6/1995 | Galbraith | |
| 5,425,426 | A | | 6/1995 | Baratov | |
| 5,449,041 | A | | 9/1995 | Galbraith | |
| 5,465,795 | A | | 11/1995 | Galbraith | |
| 5,660,236 | A | | 8/1997 | Sears | |
| 5,826,664 | A | | 10/1998 | Richardson | |
| 5,845,716 | A | * | 12/1998 | Birk | 169/73 X |
| 5,884,710 | A | | 3/1999 | Barnes | |
| 5,984,016 | A | * | 11/1999 | Samuelsson | 169/73 X |
| 6,003,608 | A | | 12/1999 | Cunningham | |
| 6,029,751 | A | | 2/2000 | Ford | |

FOREIGN PATENT DOCUMENTS

| | | | | |
|---|---|---|---|---|
| SU | 588987 | * | 1/1978 | 169/84 |
| WO | WO 98/09682 | | 3/1998 | |

* cited by examiner

*Primary Examiner*—Steven J. Ganey
(74) *Attorney, Agent, or Firm*—Sally J. Brown; James D. Erickson

(57) ABSTRACT

A device for discharging a fire retardant material comprising a housing capable of storing a fire retardant material. The housing has an initiator attached to a first end, while a discharging port is attached at a second end. Additionally, sealed within the housing is a driver which forces the fire retardant material towards the discharging port. The driver follows a path defined by a bypass tube located centrally within the housing. The driver is forced along the path by exit gases created by the initiator attached at the first end. The housing also has a choke assembly located near the second end thereof. The choke assembly selectively controls the rate at which the fire retardant material and the pressurized gases exit through the discharging port. The choke assembly has a choke body with a first and second cavity. Furthermore, choke body has passageways and apertures for directing the flow of both the fire retardant material and the pressurized gases. The choke assembly creates a pressure differential between the first end and the second end of the housing such that the first end is at a higher pressure than the second end. Therefore, the pressure differential aids in the discharging of the fire retardant material.

6 Claims, 9 Drawing Sheets

LIQUID OR FOAM FIRE RETARDANT DELIVERY DEVICE WITH PYROTECHNIC ACTUATION AND AERATION

BACKGROUND OF THE INVENTION

1. The Field of the Invention

The present invention relates to an apparatus and method for delivering a fire retardant material. More particularly, the invention relates to a fire retardant delivery device which delivers an aerated liquid or foam in a controlled manner.

2. The Relevant Technology

Apparatus for discharging fire retardants are well known in the art. Typically, a fire retardant delivery device is activated by a signal from a detector or sensor that indicates that a quantity of retardant is needed due to the detection of smoke or increased temperature. One type of fire retardant delivery device, is shown generally in FIG. 1 as reference number 10. This fire retardant delivery device 10 utilizes a pressure generator 12 which causes the rapid creation of a pressurized gas.

Once the pressurized gas is generated, it is forced through orifices 18 and 19 to push against the top of a piston 20 as depicted in FIG. 1. Piston 20 is forced downward, as shown by arrows A, along a path defined by a tube 24. As piston 20 is moved it compresses fire retardant material 22 which is contained within casing 26. Simultaneously, a portion of the pressurized gas is also directed through hole 36 and through tube 24 to heat fire retardant 22 so as to aid in the vaporization thereof.

As piston 20 is forced to compress fire retardant material 22, the pressure of fire retardant material 22 within chamber 14 increases until burst disks 28 and 30 rupture. Once burst disks 28 and 30 rupture, fire retardant material 22 is forced out of casing 26, through exit orifices 32 and 34. Thereafter fire retardant material 22 is expelled out of diffuser 38 by way of diffuser hole 40. The high velocity at which fire retardant material 22 is forced from exit orifices 32 and 34 results in fire retardant material 22 becoming atomized.

Fire retardant material 22 is also heated by the hot pressurized gas created by generator 12 and which exits tube 24. The temperature of fire retardant material 22 is raised by the pressurized gases such that it is vaporized as it leaves diffuser holes 40. The temperature is controlled by regulating the flow rate of the hot pressurized gas which exits tube 24. The flow rate is adjusted to be the minimum rate which is necessary to insure the complete vaporization of fire retardant material 22 when it is discharged from diffuser holes 40 at the lowest expected environmental temperature.

Current designs and technology of available fire retardant delivery devices, such as fire retardant delivery device 10, have several problems that adversely effect the performance of the delivery of a fire retardant. One problem is that this type of fire retardant delivery device 10 only provides for the delivery of an atomized and vaporized fire retardant material 22. In some situations it is necessary to use an aerated liquid or foam to combat a fire or explosion. A fire retardant delivery device such as fire retardant delivery device 10, illustrated in FIG. 1, is not capable of delivering an aerated liquid or foam since the high temperatures introduced by the pressurized gas flowing through tube 24 causes vaporization of fire retardant material 22 rather than aeration. Similarly, this type of fire retardant delivery device 10 is not capable of delivering fire retardant material 22 with a predetermined ratio of gas to liquid, since this type of device only delivers a vaporized fire retardant material 22 through diffuser holes 40 and not an aerated fire retardant material.

Yet another problem with this type of fire retardant delivery device 10 is that there is no control over the discharge of fire retardant material 22 in relation to the discharge of pressurized gases through tube 24. The rate at which pressurized gases are discharged through tube 24 is controlled to cause vaporization of fire retardant material 22. There is no control which will prevent the exhaustion of pressurized gases prior to the complete delivery of fire retardant material 22. This is a problem since it is necessary for substantially all of fire retardant material 22 to be discharged to combat a fire or explosion.

Accordingly, there is a need to create a fire retardant delivery device which overcomes the foregoing disadvantages. In addition, there is a need to improve fire retardant delivery devices such that there is greater control over the distribution of numerous types of fire retardant materials.

SUMMARY AND OBJECTS OF THE INVENTION

It is an object of the present invention to provide a fire retardant delivery device which is capable of a controlled discharge of a fire retardant material.

It is another object of the present invention to provide a fire retardant delivery device which is capable of discharging numerous types of fire retardant material.

It is another object of the present invention to provide a fire retardant delivery device which will discharge an aerated liquid or foam with a predetermined ratio of gas to liquid.

It is yet another object of the present invention to provide a fire retardant delivery device which will discharge substantially all of the fire retardant material before the exhaustion of the pressurized gas which is used to drive the fire retardant material.

A further object of the present invention is to provide a fire retardant delivery device which will actuate on command.

Yet another object of the present invention is to provide a fire retardant delivery device which is compact and portable.

To achieve the foregoing objects, and in accordance with the invention as embodied and broadly described herein, a device for discharging a fire retardant material is provided that includes a housing capable of storing a fire retardant material. The housing has an initiator attached to a first end, while a discharging port is attached at a second end. Additionally, sealed within the housing is a driver which forces the fire retardant material towards the discharging port. The driver follows a path defined by a bypass tube located centrally within the housing. The driver is forced along the path by exit gases created by the initiator attached at the first end. The housing also has a choke assembly located near to the second end thereof. The choke assembly selectively controls the rate at which the fire retardant material and the pressurized gases exit through the discharging port. The choke assembly includes a choke body with a first and second cavity. The second cavity directs the exit gases towards an aperture which connects with the first cavity. In turn, the first cavity is connected to the fire retardant material by passageways. Furthermore, first cavity is configured to aid in mixing and distribution of the exit gases and the fire retardant material through the discharging port. The choke assembly also creates a pressure differential which aids in the discharge of the fire retardant material. The pressure differential exits between the first end and the second end of the housing such that the first end is at a higher pressure than the second end.

When the initiator is activated, the exit gases flow through both side apertures and an exit hole located in the bypass tube. As the exit gases flow through the side apertures they force the driver toward the second end of the housing and compress the fire retardant material within the housing. Simultaneously, the exit gases flow toward the exit hole of the bypass tube. Both the exit gases and the fire retardant material remain within the housing for a short period of time due to a number of burst disks attached to the choke assembly. Once the pressure within the housing is sufficient, the burst disks rupture and allow fire retardant material and exit gases to flow through the choke assembly. Specifically the exit gases pass through the exit hole and are controlled by both the second cavity and the aperture. The aperture is in communication with the first cavity and further limits the flow of exit gases therethrough. Passageways are also in communication with the first cavity and restrict the flow of fire retardant material. Exit gases and fire retardant material are mixed in first cavity and then discharged through discharge port.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention relates to a device to deliver a fire retardant material in a controlled manner. The controlled delivery of fire retardant material results in better distribution of fire retardant material, more efficient use of the fire retardant material contained within the fire retardant delivery device, and better elimination of a fire. By increasing the efficiency of the fire retardant delivery device, smaller and more compact fire retardant delivery devices may be used to combat fires and/or explosions.

Figure 1:
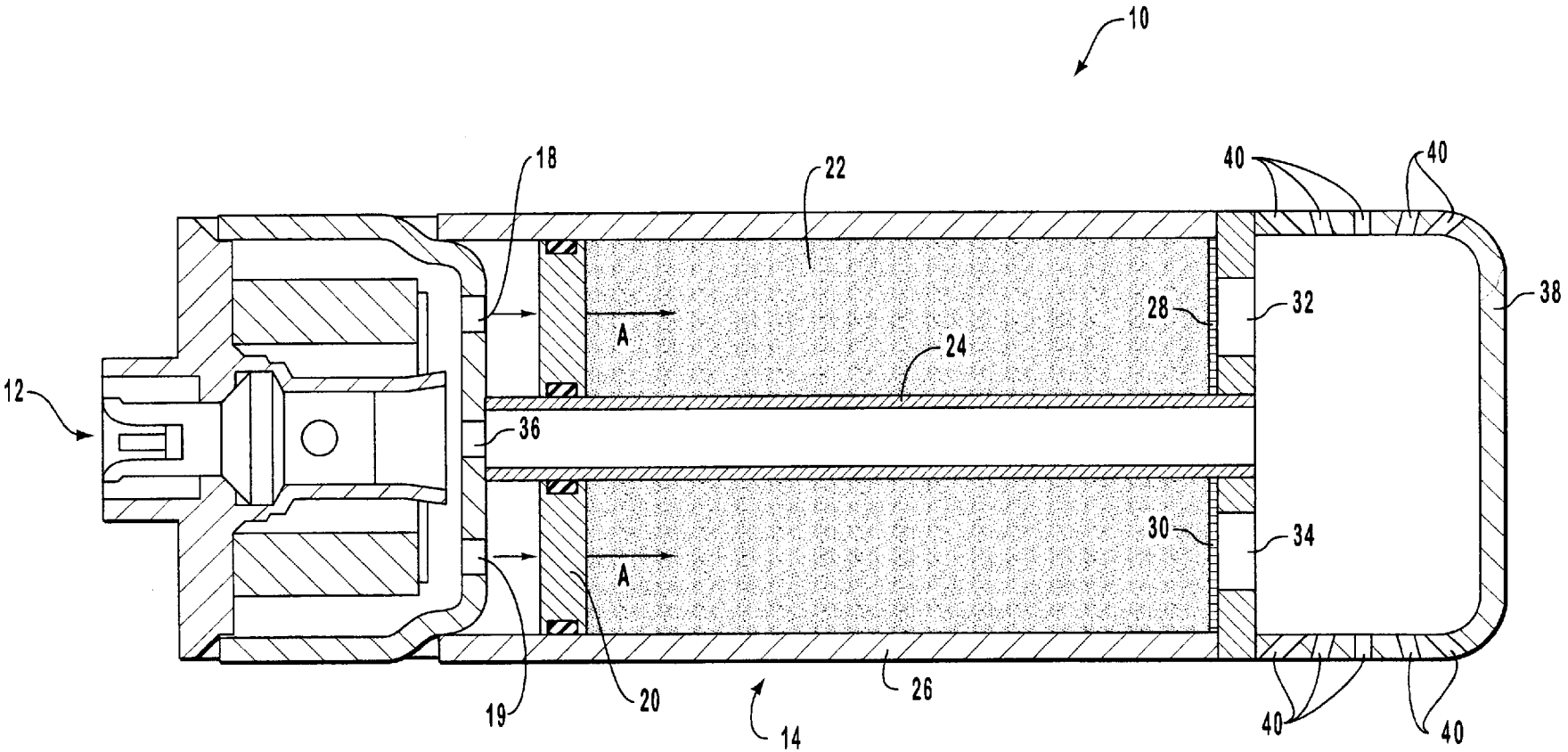
FIG. 1 (PRIOR ART)
FIG. 1 is a cross-sectional side view of one embodiment of a prior art fire retardant delivery device.
Figure 2:
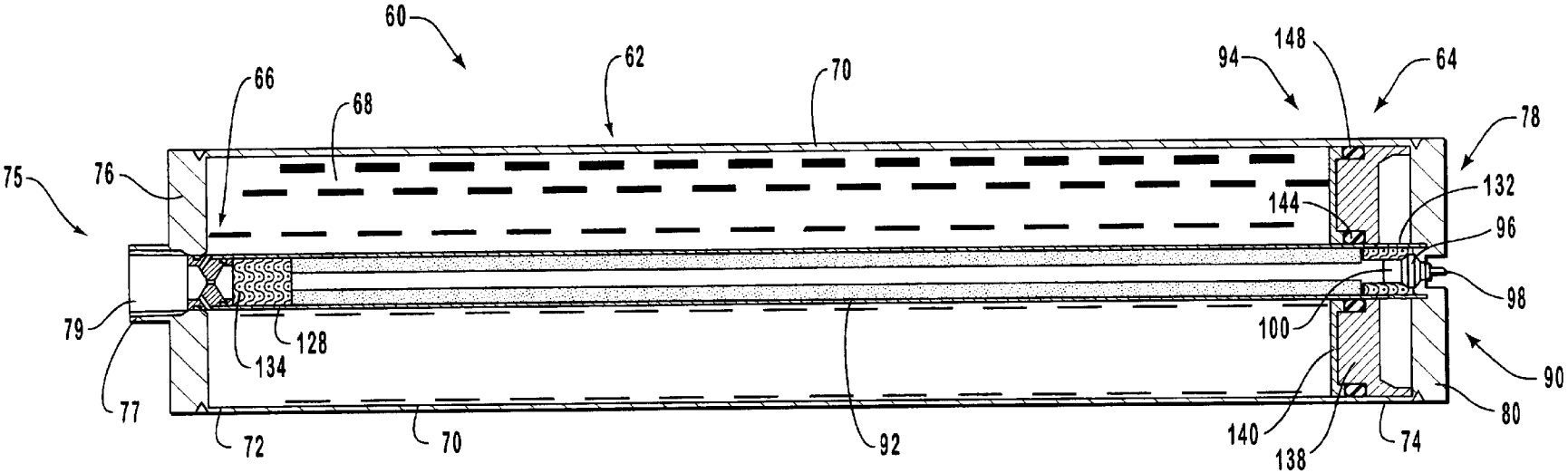
FIG. 2 is a cross-sectional side view of one embodiment of a fire retardant delivery device.

FIG. 2 depicts one embodiment of a device for discharging a fire retardant material 68 in a controlled manner. As shown, delivery device 60 comprises a housing 62, a drive assembly 64 and a choke assembly 66. Housing 62 comprises a generally tubular body 70, a discharging port 75 and end cap 78. Tubular body 70 has a first end 72 and a second end 74. First end 72 and second end 74 are configured with substantially the same cross-section. Tubular body 70 is configured to securely hold fire retardant material 68 prior to delivery and to withstand the pressures associated with the delivery of fire retardant material 68. Tubular body 70 is also configured to provide structural support for drive assembly 64 and choke assembly 66.

It will be appreciated, in view of the teaching herein, that one skilled in the art can identify various other configurations of housing 62. For example, housing 62 may have various cross-sections such as rectangular, square, oval, trapezoidal, triangular or the like. Furthermore, first end 72 and second end 74 may not have the same cross-section. First end 72 may have a smaller cross-section than second end 74 and vice versa. Housing 62 may also be formed from multiple pieces which are bonded or coupled together using, by way of example, welds, threads, adhesives, brazing, or the like. Various other configurations of housing 62 are effective in carrying out the intended function thereof.

Housing 62 is preferably composed of materials which will be easily manufactured while providing sufficient strength and rigidity to withstand the pressure associated with delivery of fire retardant material 68. The types of material may range from metals, composites, Iconel, and alloys thereof. It is preferred that housing 62 be substantially composed of steel.

According to another aspect of the present invention, housing 62 comprises discharging port 75. Discharging port 75 has a first generally cylindrical portion 76 with a port portion 77 axially coincident with first generally cylindrical portion 76. Port portion 77 is formed with a cavity 79 therethrough which allows fire retardant material 68 to be discharged therefrom.

It will be appreciated, in view of the teaching herein, that one skilled in the art can identify various other configurations of discharging port 75. For example, discharging port 75 may have various cross-sections such as rectangular, square, oval, trapezoidal, triangular or the like provided that discharging port 75 will cooperate with first end 72 of tubular body 70. Discharging port 75 may have dimensions similar to those of first end 72 of tubular body 70. In another configuration, discharging port 75 is integrally formed with tubular body 70 such that first end 72 of tubular body 70 actually is discharging port 75. In yet another configuration, discharging port 75 is a separate element which is joined to tubular body 70. The joining process may include the use of welding, adhesives, brazing, mechanical joints such as threads or slip fits, or other similar joining techniques.

In another configuration first cylindrical portion 76 may have a larger diameter than first end 72. In yet another configuration first cylindrical portion 76 may have a smaller diameter than first end 72. In still another configuration, port portion 77 has a truncated cone shaped cavity and form. Port portion 77 may have various dimensions which allow the discharge of fire retardant material 68 efficiently and effectively. Various other configurations of discharging port 75 and port portion 77 are effective in carrying out the intended function thereof.

Discharging port 75 is preferably composed of materials which will be easily manufactured while giving sufficient strength and rigidity to withstand the pressure associated with delivery of fire retardant material 68. The types of material may range from metals, composites, Iconel, and alloys thereof. It is preferred that discharging port 75 be substantially composed of steel.

Figure 3:
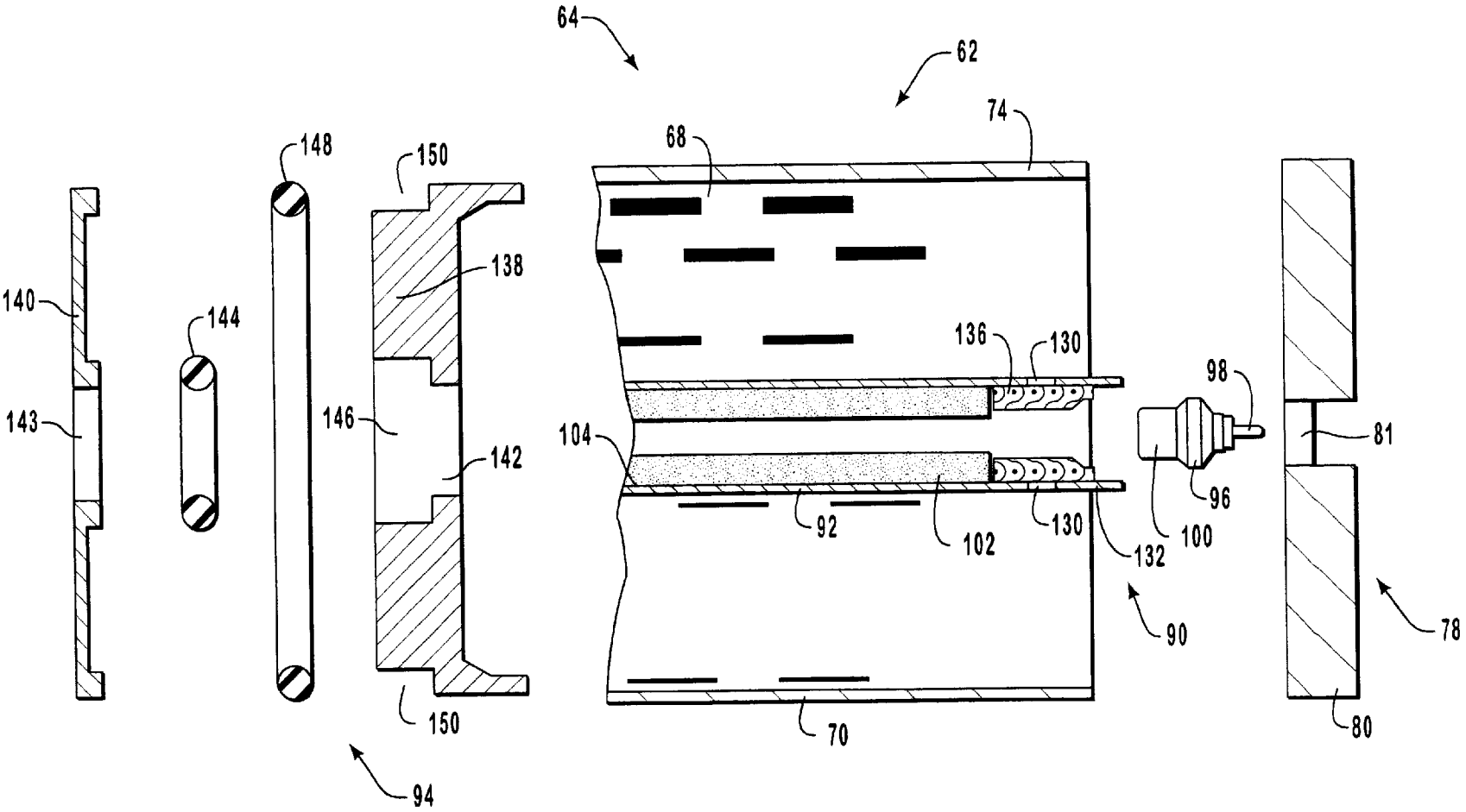
FIG. 3 is an exploded cross-sectional side view of one embodiment of a driver assembly of FIG. 2.

According to another aspect of the present invention, housing 62 comprises an end cap 78. As shown in FIG. 3, end cap 78 has a generally cylindrical body 80 provided with a drive recess 81. Drive recess 81 is configured to cooperate with drive assembly 64.

It can be appreciated that, one skilled in the art can identify various other configurations of end cap 78 which are also capable of carrying out the intended function thereof. For example, end cap 78 may have various cross-sections such as rectangular, square, oval, trapezoidal, triangular or the like. End cap 78 may have multiple drive recesses 81 or no drive recesses 81 dependent on the type of drive assembly 64 used. The dimensions of end cap 78 may vary based on the dimensions of second end 74. Furthermore, end cap 78 may have a larger or smaller diameter than second end 74. In another configuration, end cap 78 is integrally formed with tubular body 70 such that second end 74 of tubular body 70 actually is end cap 78. In yet another configuration, end cap 74 may be a separate element which is joined to tubular body 70. The joining process may include the use of welding, adhesives, brazing, mechanical join such as threads, or other similar joining techniques.

End cap 78 is preferably composed of materials which will be easily manufactured while giving sufficient strength and rigidity to withstand the pressured associated with delivery of fire retardant material 68. The types of material may range from metals, composites, Iconel, and alloys. It is preferred that end cap 78 be substantially composed of steel.

Drive assembly 64 comprises an initiator assembly 90, a bypass tube 92 and a driver 94. Initiator assembly 90 comprises an initiator 96 with at least one initiator pin 98 and an initiator charge 100. Initiator 96 is coupled within cylindrical body 80 as shown in FIG. 2, such that initiator pin 98 extends outside housing 62 while initiator charge 100 is located within bypass tube 92. Referring back to FIG. 3, initiator charge 100 is activated as a signal is transmitted to initiator pin 98, thereby activating, in one illustrative configuration, a pyrotechnic charge 102 which is coupled to an inner surface 104 of bypass tube 92. Pyrotechnic charge 102 creates exit gases and a plurality of inflation products.

In view of the teaching contained herein, various other configurations of initiator assembly 90 are also effective in carrying out the intended function thereof. For example, initiator assembly 90 may create exit gases, dissociate pressurized gases contained within housing 62 to form exit gases, or both create exit gases and dissociate pressurized gases or a gaseous mixture. In another configuration, initiator 96 may include a squib, which is a type of pyrotechnic, a bridgewire, a spark discharge, a semiconductor bridge, a projectile, or a heated or exploding foil or wire. In another configuration, initiator 96 need not be located within bypass tube 92 but may be close to bypass tube 92.

In yet another configuration, initiator 96 may be within a cavity or recess which leads to bypass tube 92. In yet another configuration, initiator 96 does not include initiator charge 100 but is configured such that the activation of initiator 96 causes the excitation, dissociation or creation of the exit gases, such as with a semi-conductor bridge and a reactive gas. In yet another configuration, initiator charge 100 is a pyrotechnic charge which creates exit gases. In still yet another configuration, pyrotechnic charge 102 is configured to couple to inner surface 104 along the complete length of bypass tube 92. In still another configuration, pyrotechnic charge 102 couples to only a small section of inner surface 104 of bypass tube 92. In general, initiator 96 is configured to cause the creation of exit gases through a gas generating material, the dissociation of a pressurized gas, or combination thereof, such that the exit gases are directed through bypass tube 92 and towards driver 94. Various configurations and types of initiator assembly 90 are effective in carrying out the intended function.

According to another aspect of the present invention, driver assembly 64 includes bypass tube 92 which has a tubular form. Referring to FIG. 2, driver assembly 64 also includes a first strainer 134 and a second strainer 136 (FIG. 3). Bypass tube 92 has a first end 128 and a second end 132. Bypass tube 92 has an exit hole (not shown) at a first end 128 and side apertures 130 shown in FIG. 3 at second end 132. The longitudinal axis of bypass tube 92 corresponds to the longitudinal axis of housing 62 and initiator 96. As shown in FIG. 2, first end 128 is configured to cooperate with choke assembly 66, while second end 132 is configured to cooperate with initiator assembly 90, thereby allowing exit gases to be directed to driver 94.

In view of the teachings herein, one skilled in the art can identify various other configurations of bypass tube 92 which are also effective in carrying out the intended function thereof For example, bypass tube 92 may have various cross-sections such as square, oval, triangular, trapezoidal, rectangular, or the like. In another alternate configuration, bypass tube 92 has a plurality of exit holes at first end 128. In yet another configuration, bypass tube 92 has a plurality of side apertures 130. In yet another configuration, driver assembly 64 includes a plurality of bypass tubes 92 such that there are numerous initiators 96 and numerous other elements of fire retardant delivery device 60. In yet another configuration, longitudinal axis of bypass tube 92 does not correspond with the longitudinal axis of housing 62 or initiator 96.

In another configuration, second end 132 of bypass tube 92 cooperates with a pyrotechnic charge 102 such that pyrotechnic charge 102 is located within bypass tube 92 and coupled to inner surface 104 (FIG. 3). In yet another configuration bypass tube 92 does not include pyrotechnic charge 102. In still yet another configuration bypass tube 92 cooperates with a different type of initiator 96, such as a bridgewire, a spark discharge, a semi-conductor bridge, a projectile, or a heated or exploding foil or wire in combination with stored pressurized gases.

Bypass tube 92 is preferably composed of materials which will provide sufficient strength and rigidity to securely contain the gas which is excited or created by initiator 90. The types of material range from Iconel, steel, aluminum, and alloys thereof. It is preferred that bypass tube 92 be substantially composed of steel.

As shown in FIG. 2, bypass tube 92 also comprises generally cylindrical first strainer 134 and a generally rectangular second strainer 136. First strainer 134 is located within bypass tube 92 at first end 128. First strainer 134 has a generally cylindrical form so that first end 128 of bypass tube 92 is completely filled and no initiator products may circumvent first strainer 134 and exit housing 62. Second strainer 136 is located within bypass tube 92 at second end 132 as illustrated in FIG. 3. Second strainer 136 has a generally cylindrical form such that it can be easily coupled to inner surface 104 of bypass tube 92 and cover side apertures 130. First strainer 134 and second strainer 136 comprise a mesh-type material which prevents initiator products from exiting housing 62 and therefore possibly injuring a user or other individual close to delivery of fire retardant material 68. In general, first strainer 134 and second strainer 136 may have any form necessary to cooperate with driver assembly 64.

One skilled in the art can identify various other configurations of first strainer 134 and second strainer 136, which are also effective in carrying out the intended function thereof. For example, bypass tube 92 can have a plurality of strainers along the length of bypass tube. Bypass tube 92 can have a single strainer located at second end 132. The dimensions of first strainer 134 and second strainer 136 may vary based on the dimensions of bypass tube 92, exit hole (not shown) and side apertures 130. First strainer 134 and second strainer 136 may have various cross-sections such as rectangular, square, oval, trapezoidal, triangular or the like.

First strainer 134 and second strainer 136 are preferably composed of materials which have sufficient strength and rigidity to prevent the passage of inflation gas products while allowing the passage of the exit gases. The types of material range from meshes of Iconel, steel, aluminum, alloys thereof, polymers, composites and the like. It is preferred that strainers 134 and 136 be composed substantially of steel or ceramic.

According to another aspect of the present invention, as shown in FIG. 3, driver assembly 64 includes driver 94. Driver 94 comprises a first generally cylindrical body portion 138 and a second generally cylindrical body portion 140. A first center orifice 142 and a first center recess 146 are formed through first cylindrical body portion 138. First center recess 146 has a larger diameter than first center orifice 142 such that there forms a seat upon which center seal 144 may be located. A second center orifice 143 is formed through second cylindrical body portion 140. Center orifices 142 and 143, and first center recess 146 are substantially aligned and are configured to cooperate with bypass tube 92 such that driver 94 can slide along bypass tube 92. A center seal 144 is located within first center recess 146. An outer seal 148 is located within an outer recess 150 located at the peripheral edge of first cylindrical body portion 138.

Center seal 144 and outer seal 148 are secured within center recess 146 and outer recess 150 respectively when second cylindrical body portion 140 is coupled to first cylindrical body portion 138. Upon first cylindrical body portion 138 and second cylindrical body portion 140 being coupled together, as illustrated in FIG. 2, a fluid tight seal is formed by center seal 144 against bypass tube 92 and by outer seal 148 against housing 62. In general, driver 94 is configured to force fire retardant material 68 from housing 62 as exit gases are forced against it. Driver 94 also prevents exit gases from circumventing it and prematurely mixing fire retardant material 68 with the exit gases.

Various other configurations of driver 94 may be known by one skilled in the art, which are also effective in carrying out the intended function thereof. For example, driver 94 can have various dimensions or shapes such as square, circular, oval, trapezoidal or the like. In another configuration, driver 94 is formed to cooperate with housing 62. Driver 94 may have a threaded center orifice which connects with the threaded outside surface of bypass tube 92. In another configuration, driver 94 has two seals, a left seal and a right seal. The seals are configured to be located on either side of bypass tube 92 and perform the same function as center seal 144 and outer seal 148. In another embodiment, driver 94 is formed from a single body portion with a number of seals coupled thereto. In yet another configuration, driver 94 comprises a bellows with a burst disk, which is filled with fire retardant material 68. As initiator assembly 90 is activated, the bellows are compressed, the burst disk ruptures and fire retardant material 68 is released from within the bellows. In general, driver 94 is configured to drive fire retardant material 68 from within housing 62 when initiator 96 is activated.

Driver 94 is preferably composed of materials which will provide sufficient strength and rigidity while a pressured material is in contact with the surface thereof and withstand the heat associated with the exit gases. Driver 94 is also preferably composed of materials which are inactive when in contact with fire retardant material 68. The type of material range from Iconel, steel, aluminum, alloys thereof, polymers, composites and the like. It is preferred that driver 94 be substantially composed of polymer.

Drive assembly 64 is one example of structure capable of performing the function of driving means for forcing fire retardant material 68 from housing 62. In view of the teaching herein, one skilled in the art can identify various other configurations of driving means which are also effective in carrying out the intended function thereof.

Figure 4:
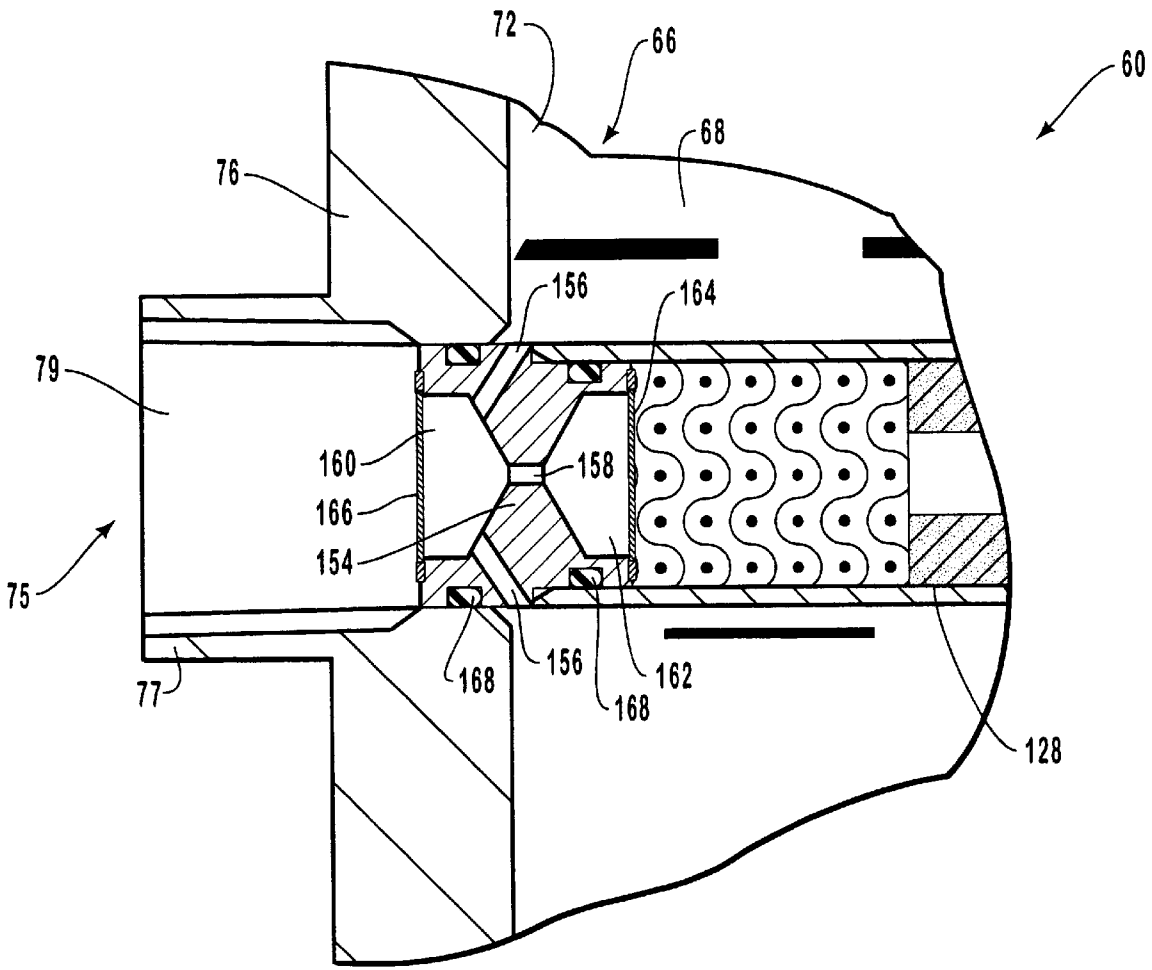
FIG. 4 is a partial cross-sectional side view of a portion of the fire retardant delivery device of FIG. 2.

According to another aspect of the present invention, as shown in FIG. 4, fire retardant delivery device 60 includes choke assembly 66. Choke assembly 66 comprises a choke body 154 configured with a first cavity 160 and a second cavity 162. First cavity 160 is in communication with second cavity 162 by way of an aperture 158. First cavity 160 is also in fluid communication with fire retardant material 68 through passageways 156. Furthermore, choke body 154 is provided with a plurality of choke seals 168 located within recesses formed about the peripheral edge of choke body 154. Choke seals 168 prevent exit gases and fire retardant material 68 from circumventing passageways 156 or choke body 154.

Passageways 156 allow fire retardant material 68 to flow into first cavity 160 prior to activation of initiator assembly 90. Choke body 154 is further provided with a bypass burst disk 164 and a delivery burst disk 166. Bypass burst disk 164 is coupled to choke body 154 over second cavity 162 and prevents the flow of exit gases into choke body 154 prior to activation of initiator assembly 90. Delivery burst disk 166 is coupled to choke body 154 over first cavity 160 and prevents the discharge of fire retardant material 68 prior to activation of initiator assembly 90. Once initiator assembly 90 has been activated, the pressure of both the exit gases and fire retardant material 68 increase until they are sufficient to rupture delivery burst disk 166 and bypass burst disk 164. As bypass burst disk 164 ruptures under the pressure exerted by the exit gases, the exit gases flow through second cavity 162 and into first cavity 160 by way of aperture 158. Simultaneously, as delivery burst disk 166 ruptures under the pressure exerted by fire retardant material 68, fire retardant material 68 is forced through passageways 156 into first cavity 160. As fire retardant material 68 and the exit gases enter first cavity 160 they mix to form the aerated mixture which is discharged through port portion 77.

One skilled in the art can appreciate that various other configurations of choke assembly 66 are also effective in carrying out the intended function thereof. For example, choke body 154 may only have one burst disk coupled thereto, and have only one cavity and one passageway. In another configuration, passageways 156 may have various cross-sections such as square, oval, rectangular, trapezoidal, or the like. Furthermore, the length of passageways 156 may vary as necessary to assist in controlling the flow of fire retardant material 68. For example, passageways 156 may be have a shorter length such that it is a hole rather than a passageway.

Aperture 158 may also have various cross-sections such as square, oval, rectangular, trapezoidal, or the like. Furthermore, the length of aperture 158 may vary as necessary to assist in controlling the flow of fire retardant material 68 and the exit gases. First cavity 160 and second cavity 162 may be of any dimension which assists with the flow of fire retardant material 68 and the exit gases. In general, the elements of choke assembly 66 are configured to control the flow of fire retardant material 68 and the exit gases which are dissociated or created by initiator 90. Furthermore, referring to FIG. 2, the configuration of choke assembly 66 also creates a pressure differential between first end 72 and second end 74 of housing 62.

Choke assembly 66 is one structure capable of performing the function of choking means for selectively controlling the rate at which fire retardant material 68 exits housing 62 such that a pressure differential exists between first end 72 and second end 74 of housing 62. The pressure differential prevents the exhaustion of the exit gases before substantially all of fire retardant material 68 is discharged from fire retardant delivery device 60. Various other structures are capable of performing the function of choking means.

Choke body 154, depicted in FIG. 4, is preferably composed of materials which will provide sufficient strength and rigidity as the exit gases and fire retardant material 68 pass therethrough. The types of material range from Iconel, steel, aluminum, alloys thereof, polymers, composites and the like. It is preferred that choke body 154 be substantially composed of steel.

Figure 5:
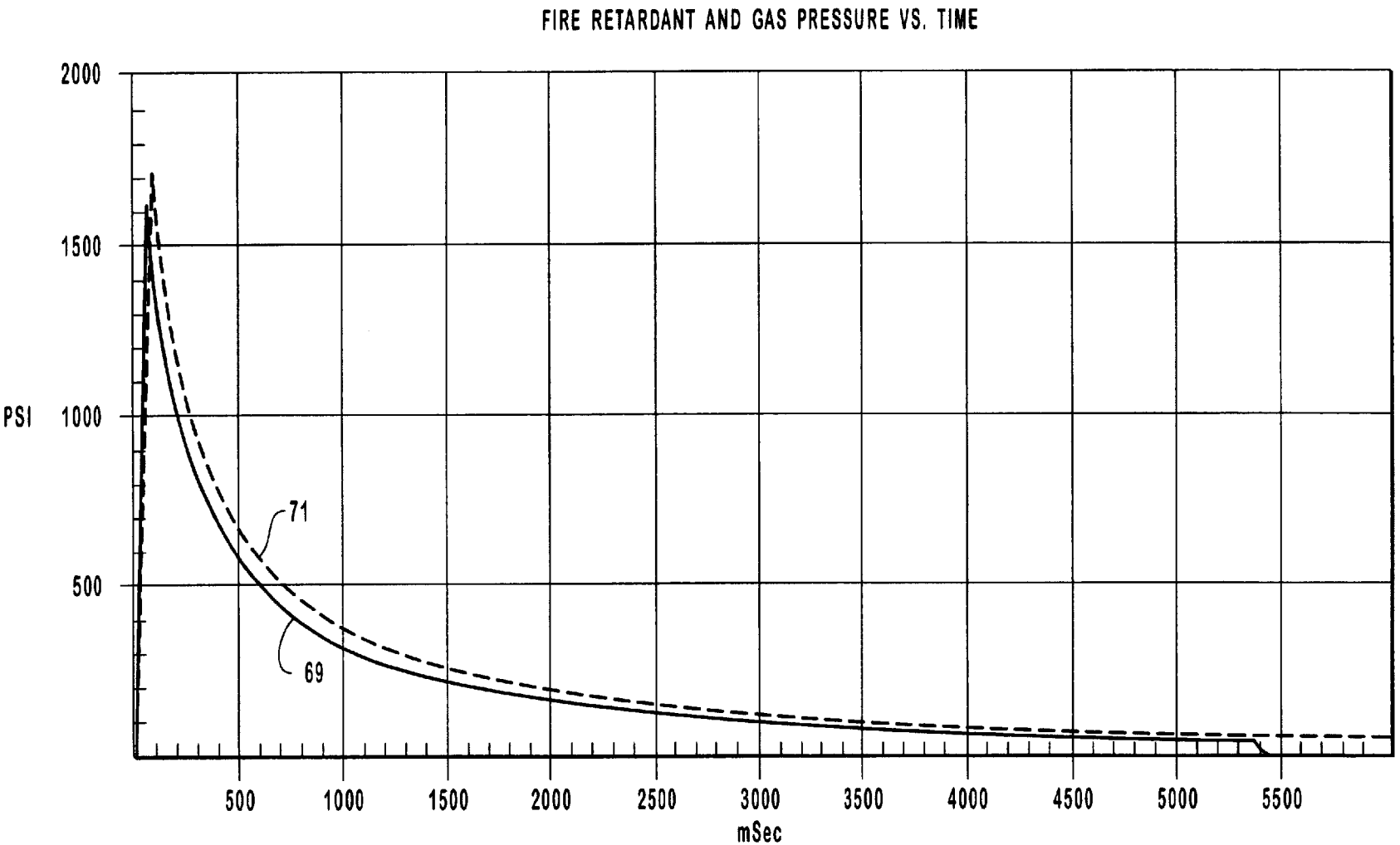
FIG. 5 is a graphical representation of the operation of the fire retardant delivery device of FIG. 2.

Referring now to the graph shown in FIG. 5, the important characteristics of the pressure differential created by choke assembly 66 are shown in relation to fire retardant material pressure against time and exit gases pressure against time. Line 69 represents the pressure of fire retardant material 68 from a non-initiated state through initiation to complete discharge. Line 71 represents the exit gases pressure within the same time period. As shown, fire retardant material 68 is rapidly pressurized within less than 100 milliseconds and then gradually decreases in pressure until a sudden drop-off point at approximately 5400 milliseconds or 5.4 seconds when driver 94 reaches first end 72 of housing 62. In contrast, the exit gases pressure does not drop to zero at 5400 milliseconds, but rather continues to gradually decline to zero at a period much greater than 5400 milliseconds. By having the pressure differential between first end 72 and second end 74 of housing 62 and the configuration of choke assembly 66, fire retardant material 68 is efficiently controlled during discharge such that substantially all of fire retardant material 68 is discharged prior to the exhaustion of the exit gases.

Figure 6:
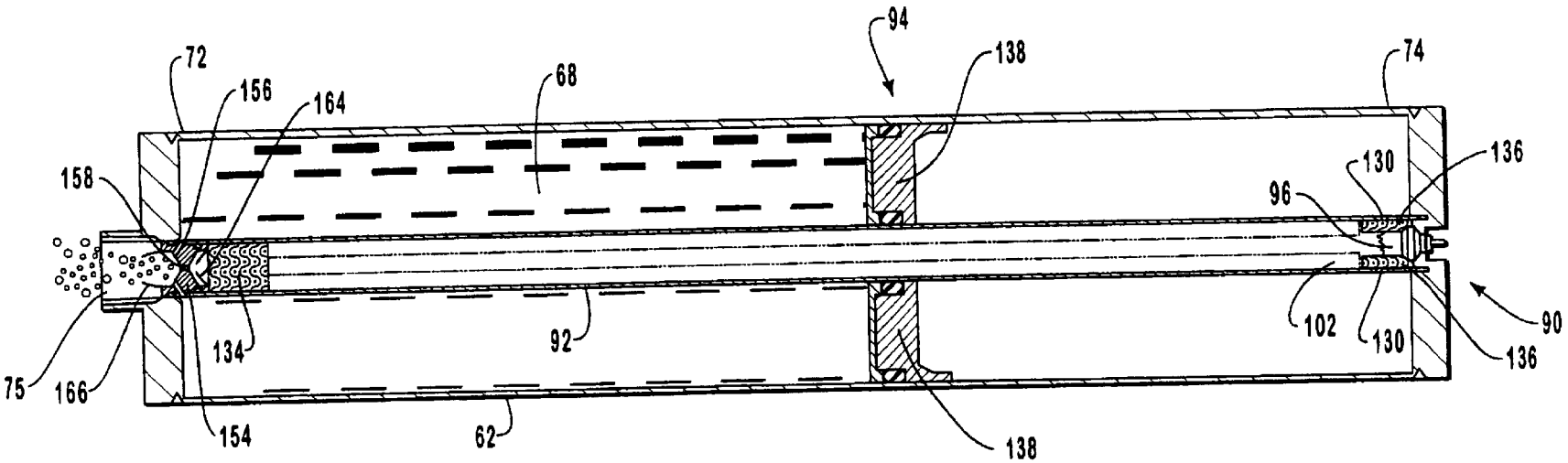
FIG. 6 is a cross-sectional side view of the structure of FIG. 2 in use.

FIG. 6 shows delivery device 60 in use. As initiator assembly 90 is activated, pyrotechnic charge 102 is activated thereby causing the creation of the exit gases. The exit gases are directed along bypass tube 92 and through side apertures 130. As the exit gases pass through second strainer 136 towards side apertures 130, the inflation products are prevented from travelling within housing 62. The exit gases are pressurized and, therefore, exert a force against first cylindrical body portion 138 of driver 94. As the quantity of exit gases increase, the forces applied to driver 94 are increased and push driver 94 towards first end 72 along bypass tube 92. Simultaneously, a force is applied to bypass burst disk 164. As the pressure increases, fire retardant material 68 is forced through passageways 156 against delivery burst disk 166, while exit gases are forced against bypass burst 164. When the critical forces are reached both bypass burst disk 164 and delivery burst disk 166 rupture as depicted in FIG. 6 thereby allowing a mixture of fire retardant material 68 and exit gases to exit through discharging port 75.

As the mixture of fire retardant material 68 and exit gases leave housing 62, a pressure differential is formed between first end 72 and second end 74 of housing 62. This pressure differential aids driver 94 in forcing fire retardant material 68 from housing 62. Furthermore, aperture 158 restricts the flow of exit gases such that substantially all of fire retardant material 68 is evacuated from housing 62 before all of the exit gases are exhausted.

Figure 7:
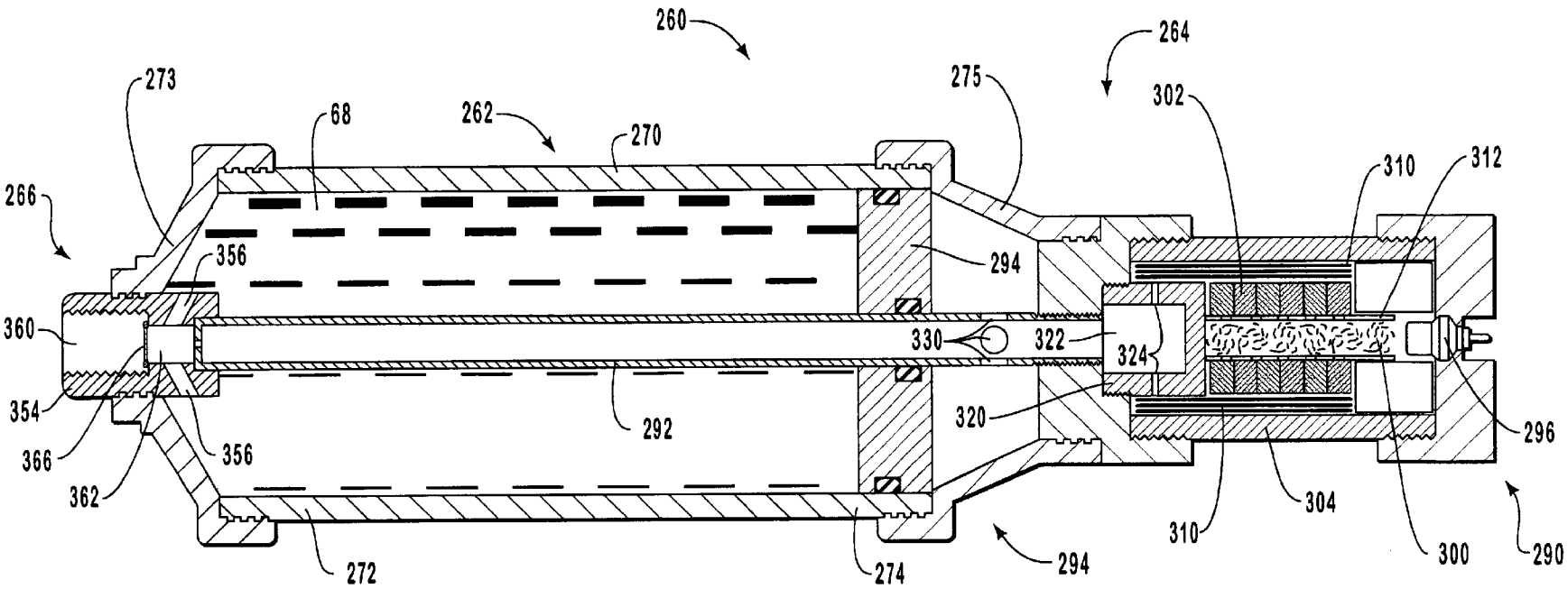
FIG. 7 is a cross-sectional side view of another embodiment of the fire retardant delivery device.

FIG. 7 illustrates another embodiment of a fire retardant delivery device 260. The majority of the features previously discussed with respect to fire retardant delivery device 60 also apply to fire retardant delivery device 260. Fire retardant delivery device 260 comprises a housing 262, a driver assembly 264 and a choke assembly 266. Housing 262 includes a generally tubular body 270, with a first end cap 273, and a second end cap 275. First end cap 273 is coupled to first end 272 of tubular body 270 and is configured to cooperate with choke assembly 266. Second end cap 275 is coupled to second end 274 housing body 270 and is configured to cooperate with driver assembly 264.

As depicted in FIG. 7, first end cap 273 and second end cap 275, are attached to tubular body 270 by threads. It can be appreciated by one skilled in the art that there are various other methods of attaching first end cap 273 and second end cap 275 to tubular body 270. For example, first end cap 273 and second end cap 275 may be coupled to tubular body 270 through other attaching methods such as welding, adhesives, brazing, mechanical bonds, or other similar joining techniques.

Figure 8:
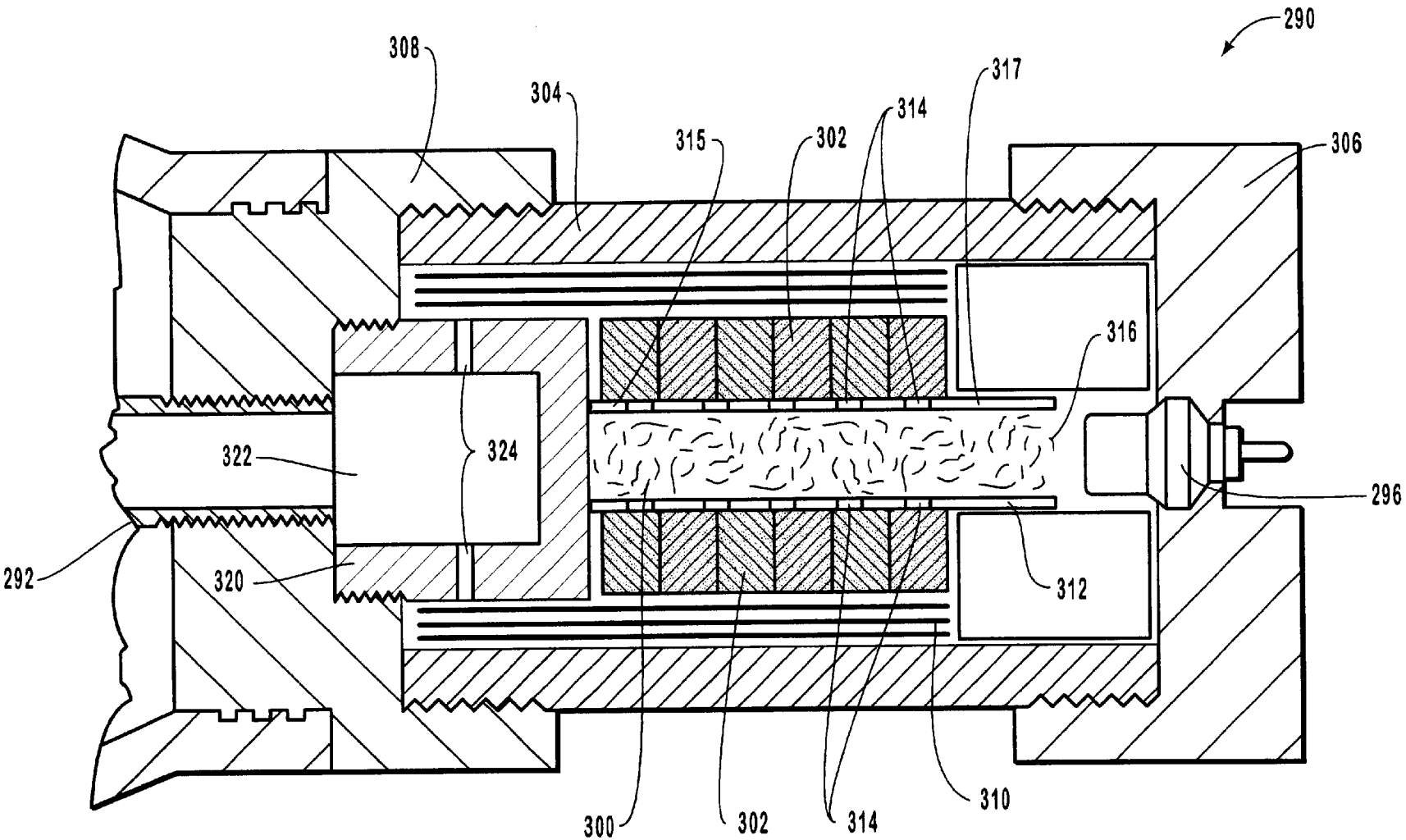
FIG. 8 is a partial cross-sectional side view of a portion of the structure of FIG. 7.

Driver assembly 264 is coupled to housing 262 and comprises an initiator assembly 290, a bypass tube 292 and a driver 294. Bypass tube 292 and driver 294 are similar to those previously discussed. Initiator assembly 290, as shown in FIG. 8, is configured to create exit gases and/or dissociate a pressurized gas to form the exit gases. Initiator assembly 290 comprises a tubular body 304, a first initiator end cap 306 and a second initiator end cap 308. Tubular body 304 is configured to securely retain the exit gases formed by the initiator assembly 290. Initiator assembly 290 also includes an initiator 296, a cooling filter 310 and a center member 312.

Various other configurations of tubular body 304 are also effective in carrying out the intended function thereof. For example, body 304 may have various cross-sections such as rectangular, square, oval, trapezoidal, triangular or the like. Furthermore, the cross-sectional dimensions of body 304 may vary along its length. Body 304 may be formed from multiple pieces which are bonded or coupled together. For example, the use of welds, screw threads, adhesives, brazing, or the like.

Body 304 is preferably composed of materials which will be easily manufactured while giving sufficient strength and rigidity to withstand the pressure associated with delivery of fire retardant material 68. The types of materials may range from metals, composites, Iconel, and alloys thereof. It is preferred that body 304 be substantially composed of steel.

Initiator assembly 290 comprises initiator end cap 306 and second initiator end cap 308. First initiator end cap 306 is similar to end cap 78 described previously. Second initiator end cap 308 is configured to cooperate with body 304 and accommodate cooling filter 310 and center member 312 located within body 304. Second initiator end cap 308 has a generally cylindrical body which is provided with a plurality of recesses. These recesses allow body 304, cooling filter 310, and center member 312 to be coupled thereto.

In view of the teaching contained herein, one skilled in the art can identify various other configurations of second initiator end cap 308 which is also effective in carrying out the intended function thereof. For example, second initiator end cap 308 may have various cross-sections such as rectangular, square, oval, trapezoidal, triangular or the like. In alternate configurations, second initiator end cap 308 may have multiple recesses therethrough to allow coupling of bypass tube 292 thereto. Similarly, second initiator end cap 308 may be coupled with the above described elements through conventional joining techniques such as through the use of welds, screw threads, adhesives, brazing, or the like. Second initiator end cap 308 is preferably composed of materials which will be easily manufactured while giving sufficient strength and rigidity to withstand the pressured associated with delivery of fire retardant material 68. The types of material may range from metals, composites, Iconel, and alloys thereof. It is preferred that second initiator end cap 308 be substantially composed of steel.

Cooling filter 310 of initiator assembly 290 is disposed within body 304 and has a generally cylindrical form. Cooling filter 310 has a number of vanes which dissipate heat as the exit gases pass over them. In general, cooling filter 310 is configured to reduce the temperature of the exits gases created by initiator assembly 290. Furthermore, cooling filter 310 allows the passage of the exit gases created by initiator assembly 290 to flow to bypass tube 292 while preventing the flow of initiator products. Various other configurations of cooling filter 310 are also effective in carrying out the intended function thereof For example, cooling filter 310 can be formed from a mesh material which has sufficiently small mesh size to prevent the passage of initiator products while being formed from materials which will cause the dissipation of heat.

Cooling filter 310 is preferably composed of materials which will be easily manufactured while having sufficient strength and rigidity to prevent initiator products passing therethrough and be able to absorb heat from the exits gases passing therethrough. The types of materials may range from wire screen or ceramic. It is preferred that cooling filter 310 be substantially composed of wire screen.

Center member 312 of initiator assembly 290 has a plurality of apertures 314 equidistantly formed therethrough. An end portion 320 is coupled to a proximal end 315 of center member 312 while a cavity 316 passes through center member 312 from proximal end 315 to a distal end 317. Cavity 316 is filled with an initiator charge 300 which is activated by initiator 296. Proximal end 315 is coupled to end portion 320 while distal end 317 is configured to accommodate initiator 296. Center member 312 is located within body 304 such that a pyrotechnic charge 302 may be located between cooling filter 310 and center member 312.

In view of the teaching contained herein, one skilled in the art can identify various other configurations of center member 312. For example, center member 312 may have plurality of apertures 314 which are not equidistantly formed therethrough. Center member 312 may have various dimensions so long as it is configured to cooperate with the other elements of driver assembly 264. For example, center member 312 may be rectangular, square, oval, trapezoidal, triangular or the like. Distal end 317 and proximal end 315 need not have the same cross-section such that distal end 317 may have a larger cross-section than proximal end 315 and vica versa. Plurality of apertures 314 may have any form necessary to allow for the passage of exit gases therethrough. For example, rectangular, square, oval, trapezoidal, triangular or the like. In another configuration, center member 312 is not filled with initiator charge 300 but partially filled. In yet another configuration, center member 312 is not filled with initiator charge 300 but accommodates initiator 96 which has an initiator charge 300 attached thereto.

Center member 312 is preferably composed of materials which will be easily manufactured while giving sufficient strength and rigidity to withstand the pressured associated with delivery of fire retardant material 68. The types of material may range from metals, composites, Iconel, and alloys thereof. It is preferred that center member 312 be substantially composed of steel.

End portion 320 has a generally cylindrical configuration with a center recess 322 located axially therein. Center recess 322 is configured to be in communication with bypass tube 292. A plurality of holes 324 pass through the walls of end portion 320 to communicate with center recess 322. Holes 324 are in communication with cooling filter 310. End portion 320 is configured such that the exit gases flow from cooling filter 310, through holes 324 and into center recess 322 which is in communication with bypass tube 292. Various other configurations of end portion 320 are also effective in carrying out the intended function thereof. For example, end portion 320 may have a various number of holes 24, such as one, two, three, or the like. Holes 324 may have any dimension which will allow for the flow of exit gases therethrough, such as rectangular, square, oval, trapezoidal, triangular or the like. End portion 320 may have numerous center recesses 322. Center recess 322 may also have any dimension to allow for the flow of exit gases.

End portion 320 is preferably composed of materials which will be easily manufactured while giving sufficient strength and rigidity to withstand the pressures associated with delivery of fire retardant material 68. The types of material may range from metals, composites, Iconel, and alloys thereof. It is preferred that end portion 320 be substantially composed of steel.

According to another aspect of the present invention, as shown in FIG. 7, fire retardant delivery device 260 comprises choke assembly 266. Choke assembly 266 comprises a choke body 354 which is configured with a plurality of passageways 356 therethrough. Choke body 354 is coupled to first end cap 273 through conventional attaching techniques such as the use of threads as depicted in FIG. 7. It can be appreciated that various other attaching methods are effective, such as welding, adhesives, brazing, mechanical bonds, or other similar attaching techniques. Passageways 356 are in communication with a second cavity 362 which is configured to cooperate with bypass tube 292. A delivery burst disk 366 is coupled to choke body 354 over second cavity 362 and prevents the flow of fire retardant 68 into a first cavity 360 prior to activation of initiator assembly 290. In this illustrative embodiment, first cavity 360 acts as a discharging port or nozzle rather than having a separate discharging port or nozzle.

In operation, initiator assembly 290 is activated by an external signal, thereby activating initiator 296 and hence initiator charge 300. Initiator charge 300 ignites and produces a quantity of exit gases and initiator products. The exit gases and initiator products flow through apertures 314 (FIG. 8) in center member 312. The exit gases and initiator products activate pyrotechnic charge 302 which generates additional exit gases. The exit gases flow through cooling filter 310 and enter center recess 322 by way of holes 324 in end portion 320. As the exit gases flow into bypass tube 292, a portion of the exit gases pass through side apertures 330 and force driver 294 towards first end 272 of housing 266. Within a short period of time, the force exerted against delivery burst disk 366 is sufficient such that it ruptures, thereby allowing fire retardant material 368 to be discharged from first cavity 360 of choke body 354. Choke body 354 controls the flow of both fire retardant material 68 and the exit gases from second cavity 362 such that substantially all of fire retardant material 68 is discharge prior to the exhaustion of the exit gases.

Figure 9:
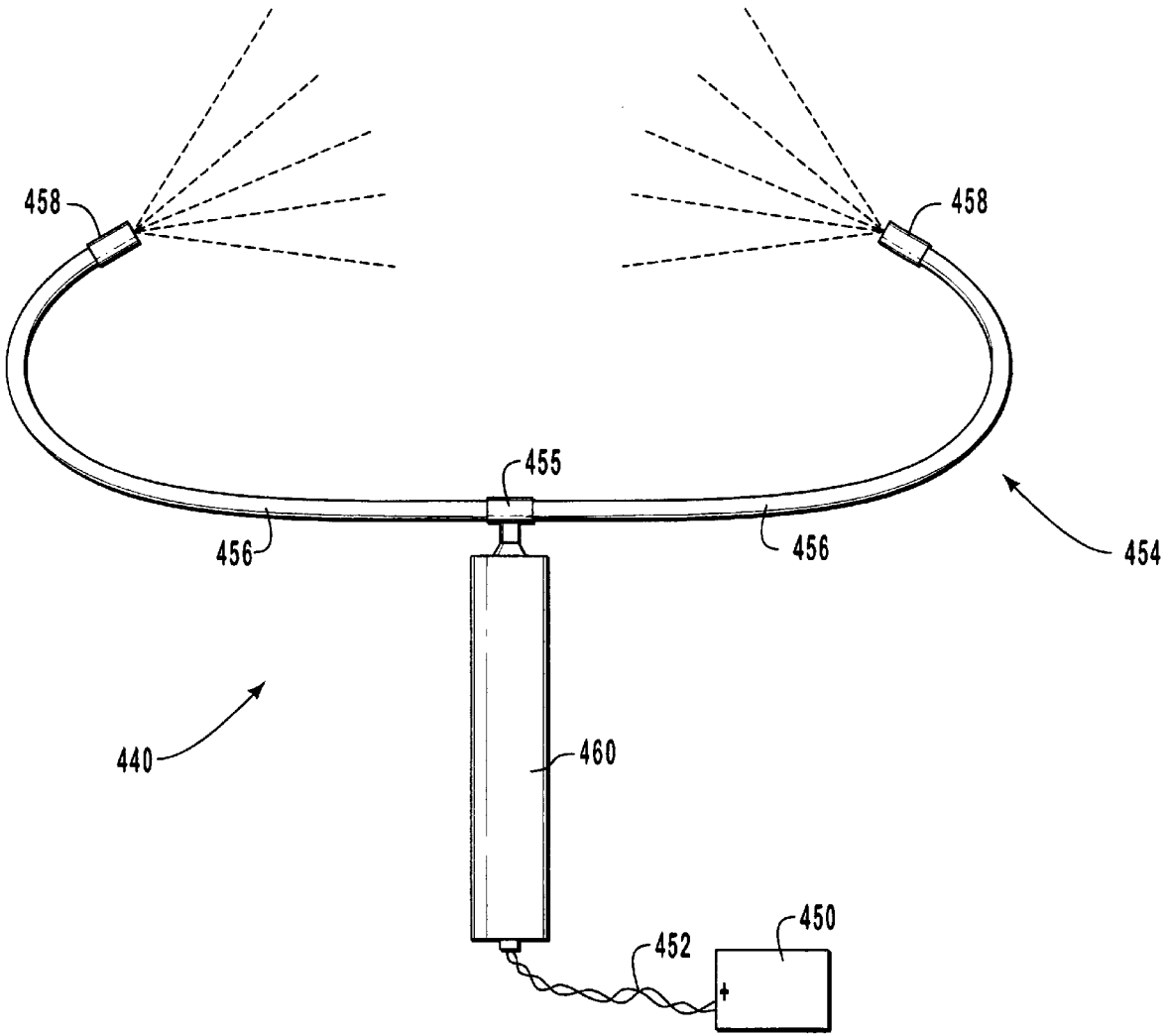
FIG. 9 is perspective view of the fire retardant delivery device.

FIG. 9 shows fire retardant delivery device 460 in operation and coupled to, in one embodiment, a fire retardant delivery system 440. Fire retardant delivery system 440 comprises activation source 450, fire retardant delivery device 460 and distribution assembly 454. Activation source 450 may comprises of any type of electrical, mechanical, thermal or the like activators which may transmit a signal to initiator assembly (not shown) contained within fire retardant delivery device 460. In this illustrative configuration, an electrical signal is sent from activation source 450, along wires 452 to the initiator assembly. As the initiator assembly is activated, the mixture of the fire retardant material and the exit gases is discharged into distribution assembly 454. Distribution assembly 454 comprises a connector 455, delivery tubes 456 and spray nozzles 458. The fire retardant material and exit gases are discharged into connector 455 of distribution assembly 454. Connector 455 splits the flow of the mixture to travel within delivery tubes 456 to then be discharged through spray nozzles 458. Spray nozzles 458 are configured to effectively distribute the mixture of fire retardant material and the exit gases such that a fire or explosion is extinguished.

In view of the teaching contained herein, one skilled in the art can identify various other features of fire retardant delivery system 440 which are also effective in carrying out the intended function thereof. For example, activation source 450 may be coupled directly to the initiator assembly. In another configuration, activation source 450 is coupled to the initiator assembly through electromagnetic wave transmitters such that as activation source 450 is activated an electromagnetic wave is transmitted to a receiver coupled to the initiator assembly within fire retardant system 440, thereby causing the discharge of the mixture of fire retardant material and exit gases. In another configuration, fire retardant delivery system 440 comprises a plurality of connector 455 which split the mixture of fire retardant material and exit gases to a plurality of delivery tubes 456 and spray nozzles 458. In yet another configuration, connector 455 directs the mixture of fire retardant material and exit gases to one delivery tube 456 and one spray nozzles 458. In yet another configuration, fire retardant delivery system 440 comprises a plurality of activation sources 450, a plurality of fire retardant delivery devices 460, and a plurality of distribution assemblies 454.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A device for discharging a fire retardant material comprising:

a housing having a first end and a second end, said housing being configured to store the fire retardant material;

driving means for forcing the fire retardant material from said housing; and a choke body provided with a passageway in communication with the fire retardant material, wherein said choke body comprises:

(a) a first cavity configured to cooperate with a discharging port and said passageway;

(b) a second cavity configured to cooperate with said driving means; and (c) an aperture which communicates between said first cavity with said second cavity.

2. A device as recited in claim 1, wherein said drive assembly comprises:

(a) an initiator assembly;

(b) a bypass tube coupled to said initiator assembly; and (c) a driver configured to cooperate with said bypass tube.

3. A device as recited in claim 1, wherein said initiator assembly comprises:

(a) a body; and (b) an initiator attached to said body, said initiator being configured to generate a pressurized gas upon being actuated.

4. A device as recited in claim 3, wherein said initiator comprises an initiator charge and a pyrotechnic charge.

5. A device as recited in claim 3, wherein said initiator comprises a pyrotechnic charge formed along the length of said bypass tube.

6. A device as recited in claim 1, wherein said passageway restricts the flow of said fire retardant material.

* * * * *